US008534376B2

(12) United States Patent
Braun et al.

(10) Patent No.: US 8,534,376 B2
(45) Date of Patent: Sep. 17, 2013

(54) PNEUMATIC-SPRING PERCUSSION MECHANISM WITH A VARIABLE ROTARY DRIVE

(75) Inventors: Helmut Braun, Bergkirchen (DE); Rudolf Berger, Grunwald (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 207 days.

(21) Appl. No.: 13/056,148

(22) PCT Filed: Jul. 28, 2009

(86) PCT No.: PCT/EP2009/005468

§ 371 (c)(1),
(2), (4) Date: Jan. 27, 2011

(87) PCT Pub. No.: WO2010/012453

PCT Pub. Date: Feb. 4, 2010

(65) Prior Publication Data

US 2011/0127055 A1 Jun. 2, 2011

(30) Foreign Application Priority Data

Jul. 29, 2008 (DE) ..... 10 2008 035 298

(51) Int. Cl.
*B25D 9/14* (2006.01)

(52) U.S. Cl.
USPC ..... 173/201; 173/114

(58) Field of Classification Search
USPC ..... 173/1, 2, 114, 117, 201
See application file for complete search history.

(56) References Cited

U.S. PATENT DOCUMENTS

2002/0056558 A1* 5/2002 Bongers-Ambrosius et al. ..... 173/201
2005/0072584 A1* 4/2005 Dresig et al. ..... 173/1

FOREIGN PATENT DOCUMENTS

| | | | |
|---|---|---|---|
| DE | 498728 | | 5/1930 |
| DE | 3311423 | A1 | 10/1984 |
| DE | 102005010737 | A1 | 9/2006 |
| DE | 102005030340 | B3 | 1/2007 |
| DE | 102006059076 | A1 | 6/2008 |
| EP | 1 607 186 | A1 | 6/2004 |
| EP | 1607186 | A1 * | 12/2005 |
| SU | 1138310 | A | 2/1985 |

OTHER PUBLICATIONS

Database WPI Week 198535, Thompson Scientific, London, GB; AN 1985-215976; Feb. 7, 1985.
International Search Report for PCT/EP2009/005468, Dated Nov. 6, 2009.

* cited by examiner

*Primary Examiner* — Alexandra Elve
*Assistant Examiner* — Nathaniel Chukwurah
(74) *Attorney, Agent, or Firm* — Boyle Fredrickson, S.C.

(57) ABSTRACT

A percussion mechanism that has a motor, a drive piston which can be moved to and fro in a guide cylinder by the motor, and a percussion piston. A coupling device is active between the drive piston and the percussion piston, via which coupling device the movement of the drive piston is transmitted to the percussion piston. The motor can be configured as a reluctance motor or as a synchronous motor. The motor can be actuable in such a way that different rotational speeds of the rotor can be generated within a percussion cycle and/or from percussion cycle to percussion cycle.

15 Claims, 6 Drawing Sheets

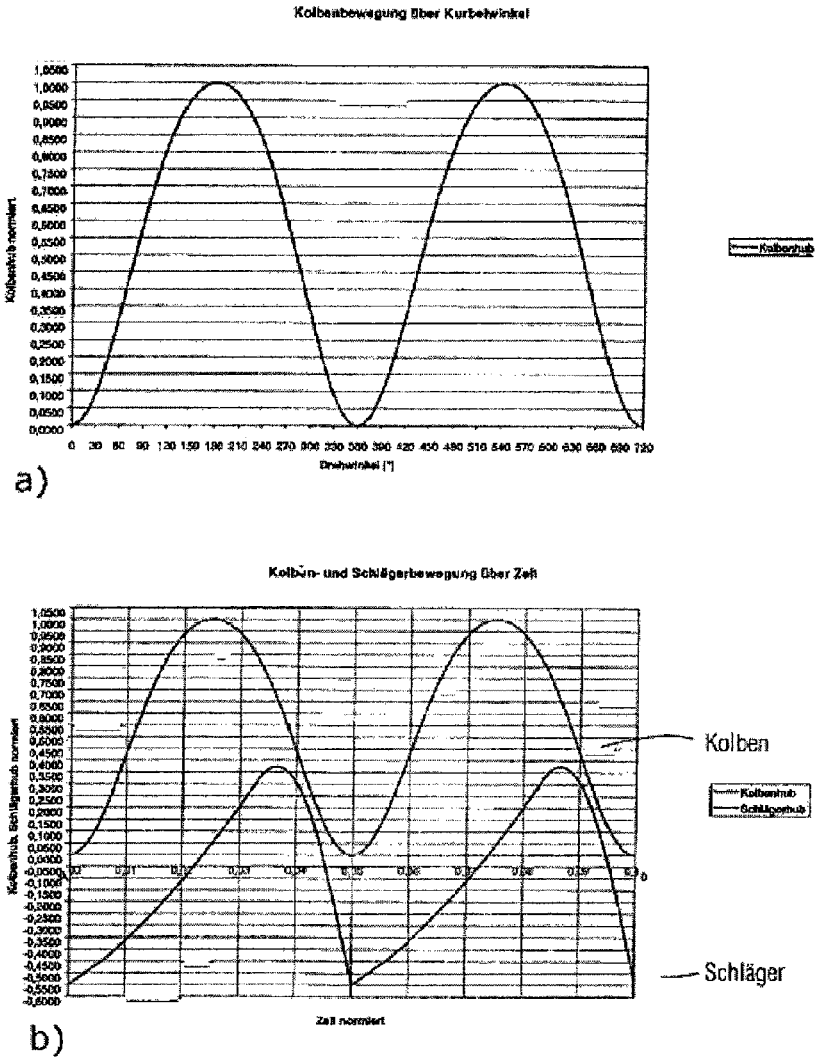

Fig. 2

Kolbenbewegung über Kurbelwinkel = Piston Movement as a Function of Crank Angle Kolbenhub = Piston Stroke Drehwinkel = Angle of Rotation Kolben- und Schlägerbewegung über Zeit = Piston and Hammer Movement as a Function of Time Kolben = Piston Kolbenhub = Piston Stroke Length Schlägerhub = Hammer Stroke Length Schläger = Hammer Zeit normiert = Time Standardized Kolbenbewegung über Kurbelwinkel = Piston Movement as a Function of Crank Angle Kolbenhub = Piston Stroke
Drehwinkel = Angle of Rotation Kolbenbewegung über Kurbelwinkel = Piston Movement as a Function of Crank Angle Kolbenhub = Piston Stroke Drehwinkel = Angle of Rotation Kolbenbewegung über Zeit = Piston Movement as a Function of Time Zeit normiert = Time Standardized Kolbenbewegung über Zeit = Piston Movement as a Function of Time
Kolbenhub exzentrisch = Eccenter-Cam Piston Stroke Schlägerhub = Hammer Stroke
Zeit normiert = Time Standardized

PNEUMATIC-SPRING PERCUSSION MECHANISM WITH A VARIABLE ROTARY DRIVE

BACKGROUND OF THE INVENTION

1. Field of the Invention

The invention relates to a percussion mechanism used as a breaker, rock-drilling hack, and/or a percussion hammer and, more particularly, relates to a percussion mechanism having a variable speed rotor whose speed variation is achieved corresponding to a pre-selected algorithm.

2. Discussion of the Related Art

Percussion mechanisms of this type are used for instance in electrically powered pavement breakers, rock-drilling jacks, and/or percussion hammers. The percussion mechanisms typically incorporate a motor that rotates in one direction at an essentially constant speed and, via a crank or wobble drive, moves a drive piston (Piston) back and forth, which later on its part, by way of a spring such as a pneumatic spring, operates a percussion piston (Hammer).

In percussion mechanisms driven by a rotary motor, the fixed geometry of the crank gear (crank radius) or of the wobble drive (oscillating stroke) locks in the throw setting of the drive piston. In most cases, the frequency of rotation during a percussion cycle is largely constant due to mass inertia. The stroke length and rotational frequency predetermine an invariable percussion intensity. Therefore, the frequency and intensity of the percussive impact cannot be independently selected.

EP 1 172 180 A2 describes a percussion mechanism driven by a rotary electric motor. The stroke travel setting of the drive piston can be varied either manually or by electric motor. That adjustment mechanism, however, is costly. Moreover, the adjustment mechanism cannot respond to varying kickback conditions within a percussion cycle.

DE 10 2005 030 340 B3 and WO 03/066286 A1 on their part describe percussion mechanisms in which the drive piston is directly actuated by an electric linear motor. The linear motor makes it possible, within certain physical limits, to individually vary the pattern of every percussion cycle. A drawback, however, consists in the fact that the armature and stator are not fully lined up over their respective length and at all times, since they pass each other in linear fashion. It follows that the structural complexity and thus the cost, as well as the weight of the motor, are greater than in the case of a rotary motor whose entire active electromagnetic surface is functionally engaged at all times.

SUMMARY OF THE INVENTION

It is the objective of this invention to introduce a percussion mechanism with a drive that makes it possible to control both the path length and the speed of the drive piston, and thus its percussive impact, during a single percussion cycle. In addition, the stroke frequency and the impact intensity are to be variably adjustable from percussion cycle to percussion cycle.

According to the invention, this objective is achieved with a percussion mechanism comprising a drive with a motor having rotor provided thereon, a drive element that can be moved back and forth by the drive in a guide unit, a percussion element, and a coupling device that acts between the drive element and the percussion element and that permits the transfer of the movement of the drive element to the percussion element.

In accordance with one aspect, the motor may be controllable such that variable rotor speeds can be generated within one percussion cycle and that, within one percussion cycle, a change of the rotor rotational speed is achieved corresponding to an algorithm that is pre-selected for the rotor. The algorithm serves to select a movement of the rotor as a function of events that occur in or through components of the percussion mechanism and, in particular, as a function of an actual movement of the percussion element.

In accordance with another aspect, the motor may be controllable in such a way that variable rotor speeds can be generated within one percussion cycle and/or from percussion cycle to percussion cycle and that, within a percussion cycle, the motor generates a reciprocating rotation of the rotor.

In a percussion mechanism incorporating a drive unit with a motor, a motor-internal rotor, a drive element in which the drive unit can move back and forth in a guide cylinder, a percussion element and, active between the drive element and the percussion element, a coupling device by means of which the movement of the drive element can be transferred to the percussion element, the motor is controllable in a manner whereby, within one percussion cycle and/or from percussion cycle to percussion cycle, the rotational speed of the rotor can be varied.

With this special control capability of the motor, it is possible to generate a particular, for instance, control-selectable individual-impact energy. Controlling the motor so precisely that, even within one percussion cycle, varying rotational speeds and, for instance, a specific movement pattern can be attained, permits the selection of a corresponding movement of the drive element that is coupled to the rotor. Accordingly, it is possible to pre-select and control the duration, the stroke length, the frequency, and, altogether, the travel/time pattern of the rotor, the drive element, and ultimately the percussion element.

The motor can be controllable in a manner whereby a change in the rotational speed within one percussion cycle and/or from percussion cycle to percussion cycle can be obtained by means of a pre-established algorithm for the movement of the rotor. For example, the algorithm may determine a fixed travel/time pattern, preset by a control and/or regulating feature, for the movement of the rotor. In that case, the time-based movement of the rotor and, correspondingly, of the drive element is pre-selected and modified for instance by operator-selected settings only.

Of course, the travel/time pattern from percussion cycle to percussion cycle can be changed. It is possible, for example, when starting up the percussion mechanism, to have an automatic, soft initial ramp-up with a relatively short stroke of the drive element but already at a high working frequency even while the operator is already activating an operating element in a way as if he wanted to run the equipment at full capacity.

It follows that the preset travel/time pattern can most certainly be varied in response to changing environmental working conditions (and, in particular, according to the operator's preferences).

It is equally possible for the algorithm to select a movement of the rotor as a function of events that occur in or through components of the percussion mechanism and especially as a function of the actual movement of the percussion element. In that case, the movement of the percussion element can be monitored by suitable means, causing the movement of the rotor and thus of the drive element to adjust itself to that of the percussion element. If, for example, the percussion element recoils through only a minor kickback, the drive element can generate a stroke length adequate for fully retracting the percussion element.

The motor can also be controlled in a manner whereby, during one percussion cycle, the motor generates a reciprocal rotary movement or a unidirectional rotation, and/or whereby the motor-actuated drive element attains a movement pattern that approximates the movement pattern of the percussion element, and/or whereby a lower dead center of the drive element in the direction of the percussion element is traversed during each percussion cycle, and/or whereby an upper dead center of the drive element away from the percussion element is traversed during each percussion cycle at least when the motor is running under full load conditions.

Thus, given the special design concept of the motor and its control feature, it is possible for the motor not to rotate at a constant speed. Instead, the rotation of the rotor in terms of speed and frequency, but also of its direction of rotation, can be variably and individually controlled from percussion cycle to percussion cycle and even within a percussion cycle. The terms percussion cycle defines the time from one percussion to the next.

Accordingly, the rotor does not have to rotate in one direction but is instead capable of a reciprocating rotational movement. It can be useful for the motor to be able to generate both a unidirectional and a reciprocating rotational movement. In that case, the motor can be controlled to rotate either unidirectionally or, on demand, to generate a back-and-forth movement, for instance, around the bottom dead center. The motor therefore requires a high degree of variability and controllability.

To that end, it will be desirable to minimize the inertia of the motor in order to allow the rotational movement of the motor and the corresponding movement of the drive element to approximate the movement pattern of the percussion element. It has been found that a harmonic sequence of percussions can be achieved especially when the distance between the drive element and the percussion element during a percussion cycle is not too great. That allows the coupling device that acts between the drive element and the percussion element, for instance, a pneumatic spring, to be kept smaller, i.e., shorter in size.

It can be useful to control the motor in a manner whereby the bottom dead center is traversed every time, i.e., in each percussion cycle, since the point of impact for all conceivable impact intensities and frequencies will always be in essentially the same location. This eliminates any structural space allowances or energy requirements for braking the piston at the bottom dead center. In particular, there is no need for a lower pneumatic reversing spring or for introducing electric braking power as is the case with a linear drive (see DE 10 2005 030 340 B3).

In this mode of operation, the theoretically possible upper dead center does not absolutely have to be traversed by the drive element, since by that time the drive element has already reversed its direction of travel.

For maximum impact intensity, i.e., during a full-load condition of the motor, it may be desirable to maintain the direction of rotation for the upper dead center as well. As a result, especially during a cycle requiring a high level of power, the expenditure of energy for braking the piston in the upper dead center will be reduced. Much like in the case of the bottom dead center, the upper dead center will require only a small reversing pneumatic spring, or indeed none, and only very little electric braking power.

A conversion system can be positioned between the motor and the drive element for converting the rotational movement generated by the motor into a linear movement of the drive element. The conversion system may incorporate suitable structural elements such as a crank gear, connecting rod, rack and pinion (even with an irregular tooth pitch), rocking link, cam disk, worm gear, wobble arm, a spatial mechanism, chain, toothed belt, belt-and-pulley drive, etc.

The conversion system can include a transmission gear whereby one percussion cycle of the motor generates several rotations of the rotor. In that case, during one percussion cycle, the motor rotates several times in the same direction up to the point where at or near the upper dead center of the drive element the direction of rotation of the motor is reversed. For that structural implementation, the motor must be designed for a higher number of revolutions. On the other hand, its torque requirement is lower, allowing the motor to be smaller in size.

Alternatively, a transmission gear of that nature, meaning an intermediate gear assembly, can be waived in order to minimize the inertial forces.

The motor may be in the form, for instance, of an asynchronous or a synchronous motor, or a reluctance motor, a claw-pole motor, or a torque motor.

In terms of its basic control function the drive unit resembles a linear motor as described, for instance, in WO 03/066286 A1 or DE 10 2005 030 340 B3, except that in this case, it is a wire-wrapped closed-loop linear motor with a revolving rotor in place of an axially moving armature as in a linear motor.

In one alternate embodiment, the drive unit may be equipped with two mutually counter rotating motors that jointly act on the drive element. In this embodiment, it will suffice to couple two relatively small-dimensioned, weak motors together that together move the drive element. Dividing the drive into two motors enhances the latitude in configuring a tool that utilizes the percussion mechanism, such as a jackhammer.

Each motor can again be individually controlled within a percussion cycle as described above and may be in the form of a reluctance motor or a synchronous motor, thus incorporating a revolving rotor while being controllable like a linear motor.

Each motor can be equipped with a conversion system for converting the rotational movement generated by the motor concerned into a linear movement of the drive element. It is equally possible to have both motors act on one joint conversion device.

The motors can also be coupled in some other fashion for jointly moving the drive element.

In one embodiment, the percussion mechanism is a pneumatic-spring percussion mechanism, the drive element is in the form of a drive piston, and the percussion element is in the form of a percussion piston. The coupling device can encompass a pneumatic drive spring formed in a hollow space between the drive piston and the percussion piston and serving to transfer the movement of the drive piston to the percussion piston.

In a derivative embodiment, the coupling device can include, in addition to the pneumatic drive spring, a pneumatic recuperating spring that is active between the drive piston and the percussion piston in order to support the return movement of the percussion piston after a percussive stroke. This creates a so-called dual-action pneumatic spring.

In contrast to a conventional rotary motor as described, for instance, in EP 1 172 180 A2, the invention permits varying the percussion frequency separately from a variation of the impact intensity. That makes it possible to achieve, for instance, a high percussion frequency at low impact intensity when setting down a chisel that is impacted by the percussion mechanism in a hammer assembly. Braking the motor more rapidly can produce idling without requiring an idling path or a special idling mechanism. Moreover, it is possible to precisely regulate the impact intensity even in the presence of a varying kickback (when the percussion element strikes the tool) by adapting the movement of the drive piston to the trajectory of the percussion element. The ratio between the drive element and the percussion element can be adjusted in adaptation to varying environmental pressures.

There are advantages even over electrodynamic drives with a linear motor. For example, full use is made of the armature and stator surfaces since the armature (rotor) and the stator are always fully lined up. Braking the drive piston requires only small reversing springs, if any, in the area of the upper and the lower dead centers since, in the case of a full stroke, the approximate location of the reversal point of the drive piston is roughly identical to the upper dead center and the lower dead center of the motor.

The design is such as to require less electric power, and thus only minor provisions for electric power buffering, permitting the use, for instance, of smaller capacitors.

given the rotary movement of its components and thus the use of rotary bearings, the motor can be sealed more easily than what is required in the case of linear motors with linear armature travel. The bearing point of the rotor, being at the inner radial center, is exposed to lower speeds than the armature of a linear motor and thus to reduced forces of inertia and friction.

These and other advantages and features are described below in more detail with reference to examples and with the aid of corresponding figures in which:

BRIEF DESCRIPTION OF THE DRAWINGS

FIG. 2 shows the movement pattern of the drive piston and the percussion piston of a conventional percussion mechanism;

DETAILED DESCRIPTION OF THE PREFERRED EMBODIMENT

Figure 1:
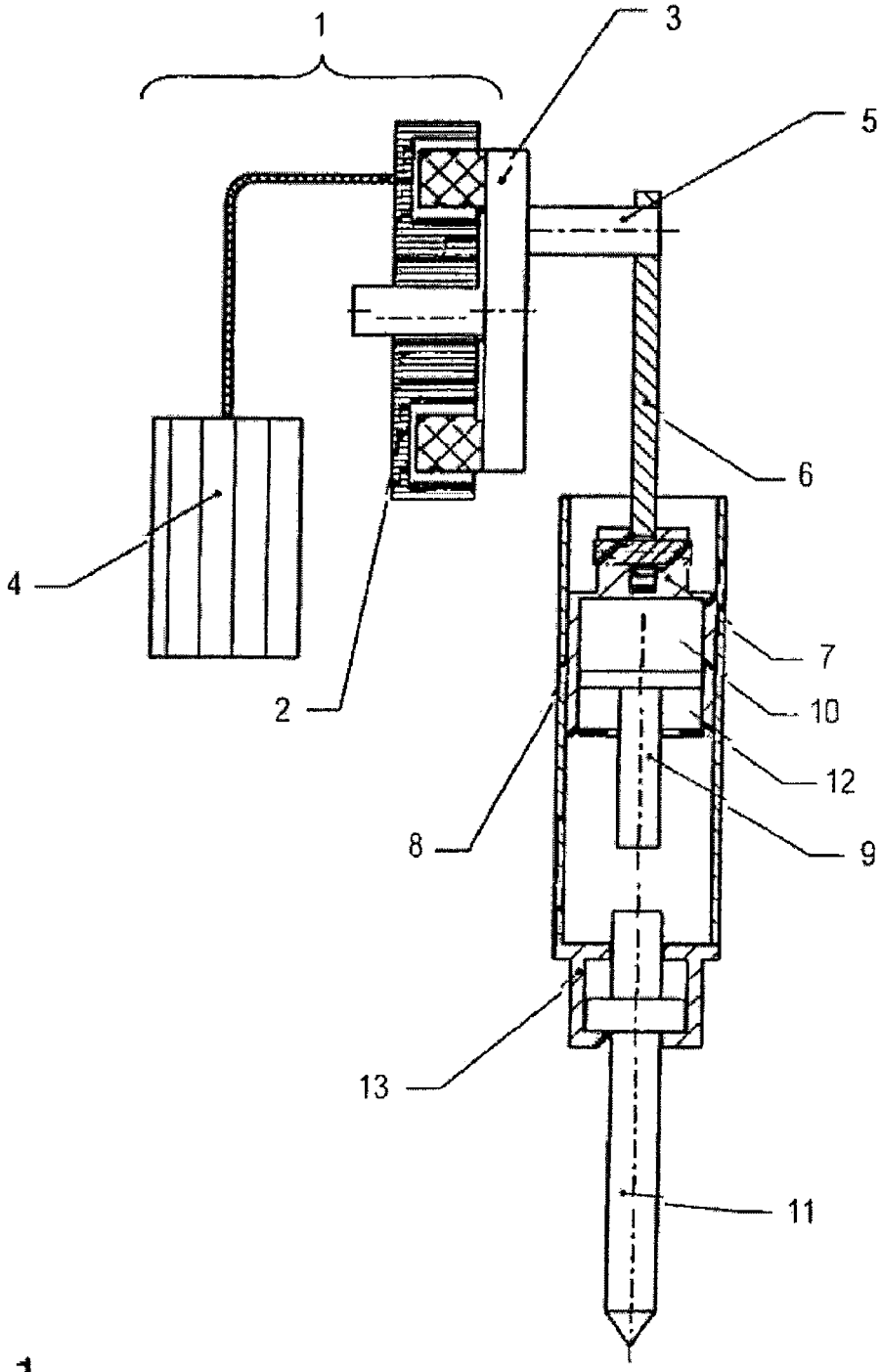
FIG. 1 is a schematic illustration of a percussion mechanism according to the invention.

FIG. 1 is a schematic side view of a percussion mechanism with a motor 1 encompassing a stator 2, a rotor 3, and an electronic control 4. The motor is a reluctance-type or synchronous motor, thus functioning as a self-contained, wire-wrapped linear motor. Within physical boundaries, electronic control 4 makes it possible to generate any desired rotational movements, travel paths, and speeds of the rotor 3.

The rotational movement of rotor 3 is transferred to a connecting rod 6 via a journal 5. Journal 5 and connecting rod 6 constitute a conversion device in the form of a crank drive.

Coupled to connecting rod 6 and serving as the drive element is a drive piston 7 that can be moved back and forth within a guide unit in the form of guide cylinder 8.

Positioned within drive piston 7 and serving as the percussion element is a percussion piston 9. Percussion piston 9 moves back and forth in a hollow space within drive piston 7. The relative movement between drive piston 7 and percussion piston 9 creates a typical pneumatic drive spring 10 that, especially during a forward movement of drive piston 7 in the direction of a chisel 11, also drives percussion piston 9 forward. Percussion piston 9 cyclically strikes chisel 11, which is mounted in a tool chuck 13.

Also located inside drive piston 7, in addition to percussion piston 9, is a pneumatic recuperating spring 12 that assists the return movement of percussion piston 9 following a percussive impact. The result is a percussion mechanism with an essentially traditional dual-action pneumatic spring.

FIG. 2 shows for a conventional rotary-drive-equipped percussion mechanism the movement of the drive piston (Piston) as a function of the crank angle (FIG. 2*a*), as well as the movement of the drive piston and of the percussion piston (Hammer) as a function of time (FIG. 2*b*).

As can be seen, the electric motor covers a 360° angle of rotation during one percussion cycle, and the piston stroke of the drive piston follows a corresponding, approximately sinusoidal path. FIG. 2 depicts two percussion cycles (720° angle of rotation).

As can be seen in FIG. 2*b* (bottom curve), the movement of the hammer follows that of the piston with a time offset, always striking in its bottom-most position.

In contrast to the movement pattern typically achievable with conventional electric motors, the invention makes it possible in the case of the percussion mechanism illustrated in FIG. 1 to control the drive piston in an individually variable fashion, as shown in FIGS. 3 to 6.

Figure 3:
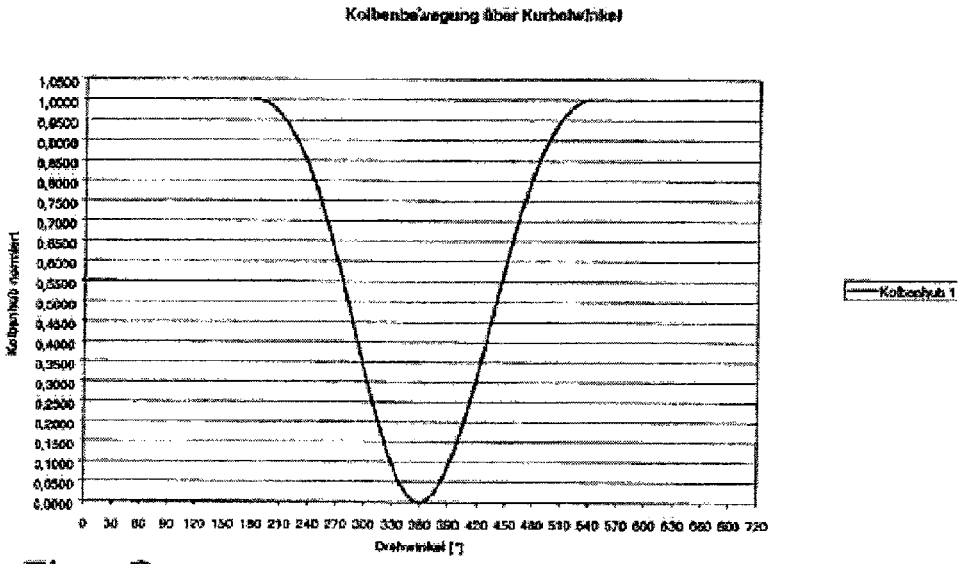
FIGS. 3 to 5 show different movement patterns of the drive piston as a function of the crank angle.

FIG. 3 shows the piston movement of drive piston 7 as a function of the crank angle. It fully utilizes the piston stroke between the maximally possible upper dead center (1.0000) and the bottom dead center (0.0000).

Figure 4:
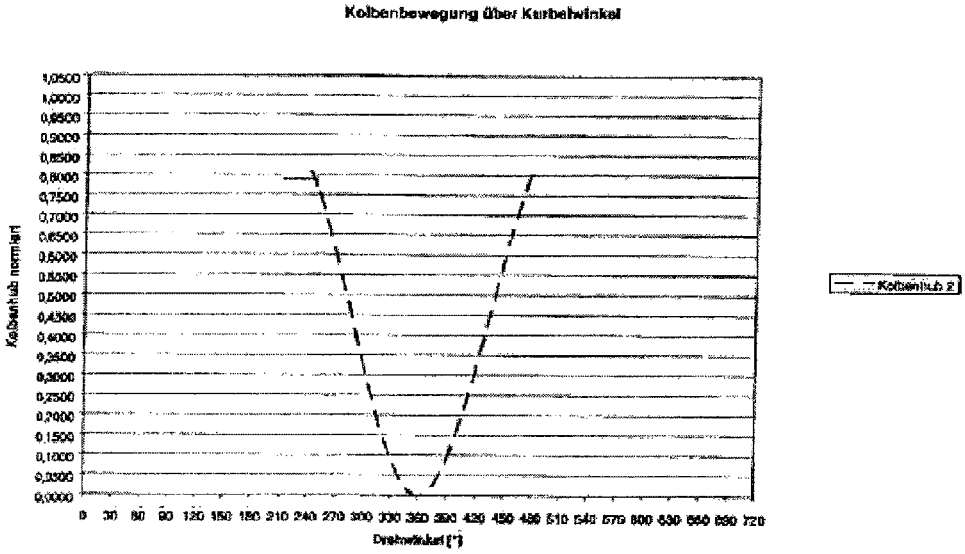

While in the depiction per FIG. 4 the drive piston reaches the lower dead center at 0.0000, it does not reach the maximally attainable upper dead center per FIG. 3, but only an upper dead center (in this case the point of reversal) at around 0.8000.

Figure 5:
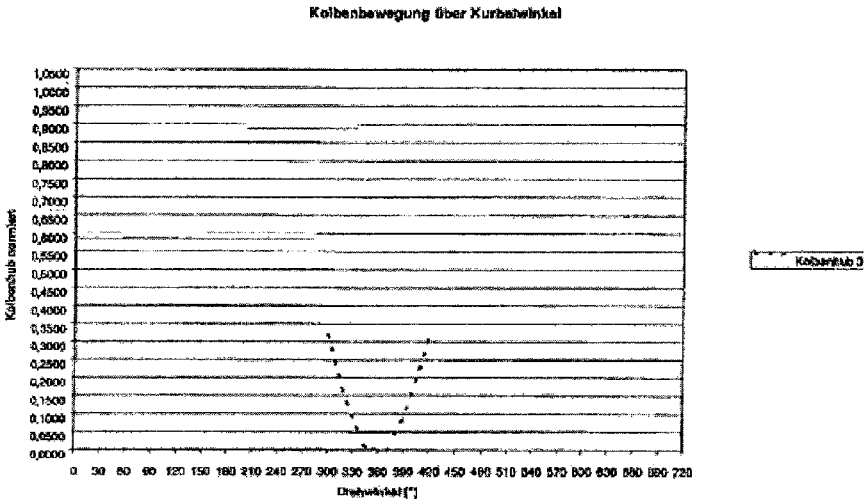

In FIG. 5, motor 1 is controlled in a manner whereby the drive piston reaches an upper dead center at only 0.3500 before already reversing direction.

The curves shown in FIGS. 3 to 5 are obtained with the aid of motor 1 in that, upon reaching the corresponding optimal angle of rotation, the direction of rotation of rotor 3 is reversed. Accordingly, drive piston 7 completes a back-and-forth movement without the need for traveling through the maximum stroke distance and traversing the maximally possible upper dead center (per FIG. 3) preset by the conversion device, such as the crank gear.

All that is necessary is to pass through the bottom dead center (position 0.0000) during each percussion cycle, as is also shown in FIGS. 3 to 5.

Figure 6:
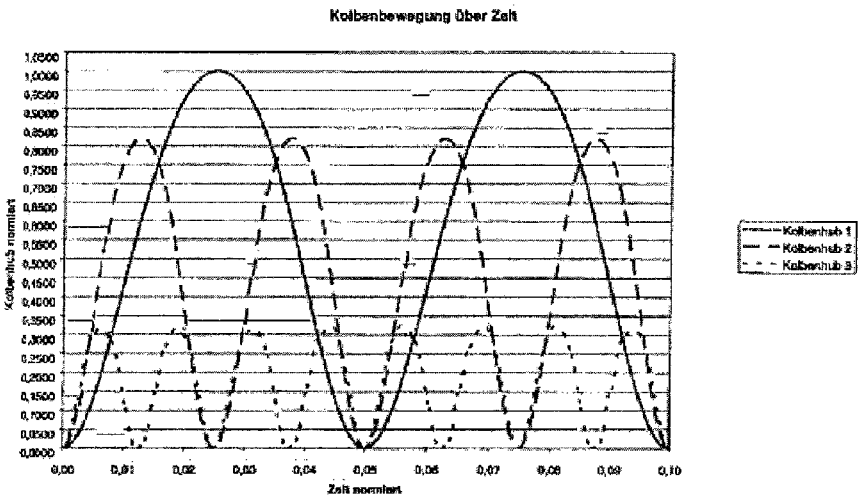
FIG. 6 shows movement patterns of the drive piston as a function of time.

These piston movements are plotted in FIG. 6 as a function of time.

It can be clearly seen that the drive piston is capable of achieving very different movement patterns, piston strokes, and frequencies, made possible by appropriately controlling motor 1. For example, with a relatively flat piston stroke per FIG. 5, it is possible to obtain a high-frequency impact sequence, whereas utilizing the maximally possible piston stroke (FIG. 3) reduces the frequency.

It can also be seen that for generating the percussion movement of drive piston 7, it is not necessary for the drive piston to pass through the upper dead center (position 1.0000).

As an alternative to the embodiments shown in FIGS. 3 to 5, it is equally possible not to pass through the bottom dead center during each percussion cycle. In that case, the direction of rotation of rotor 3, and thus the direction of travel of the drive piston, can be reversed even before the crank gear (or a corresponding rack-and-pinion or other device), i.e., the drive piston, has reached the theoretically possible lower dead center. The drive piston will initially move downward due to the rotation of rotor 3 but will be braked before reaching the theoretically possible lower dead center and will then be moved back again. In this fashion and with this embodiment, analogous to what has been described for the upper dead center in connection with the embodiments per FIGS. 3 to 5, the bottom dead center will not be traversed. The reciprocating movement of rotor 3 produces a back-and-forth movement of the drive piston without the latter passing through the lower or upper dead center.

Figure 7:
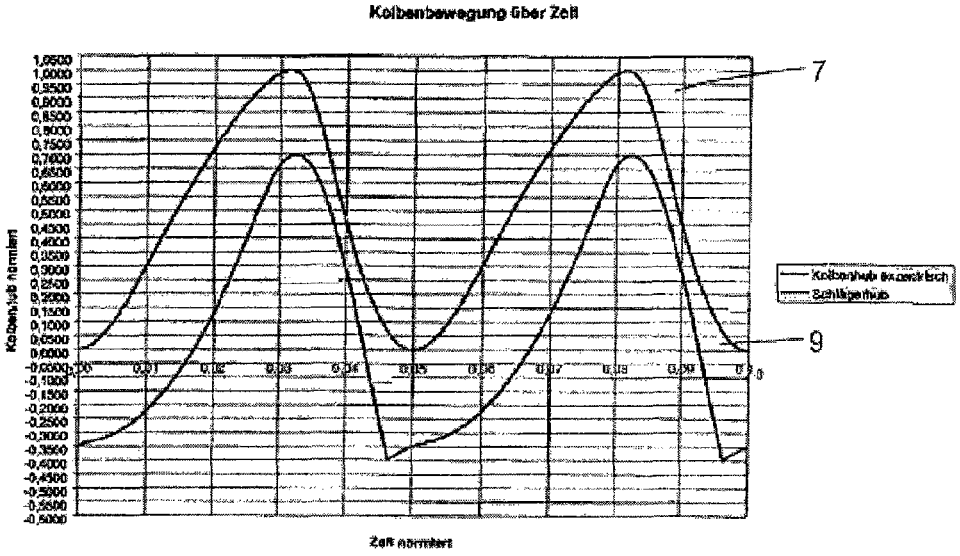
FIG. 7 shows the drive-piston and percussion-piston movement of the percussion mechanism per FIG. 1.

FIG. 7 shows an example of the movement of drive piston 7 and of percussion piston 9 over time.

Unlike the piston-hammer movement of a conventional percussion mechanism as shown in FIG. 2*b*, the movement patterns of drive piston and of percussion piston 9 are clearly similar. The maximally attainable axial distance between them is considerably shorter than that in prior art. Accordingly, the size, for instance, of pneumatic drive spring 10, can be reduced.

Figure 8:
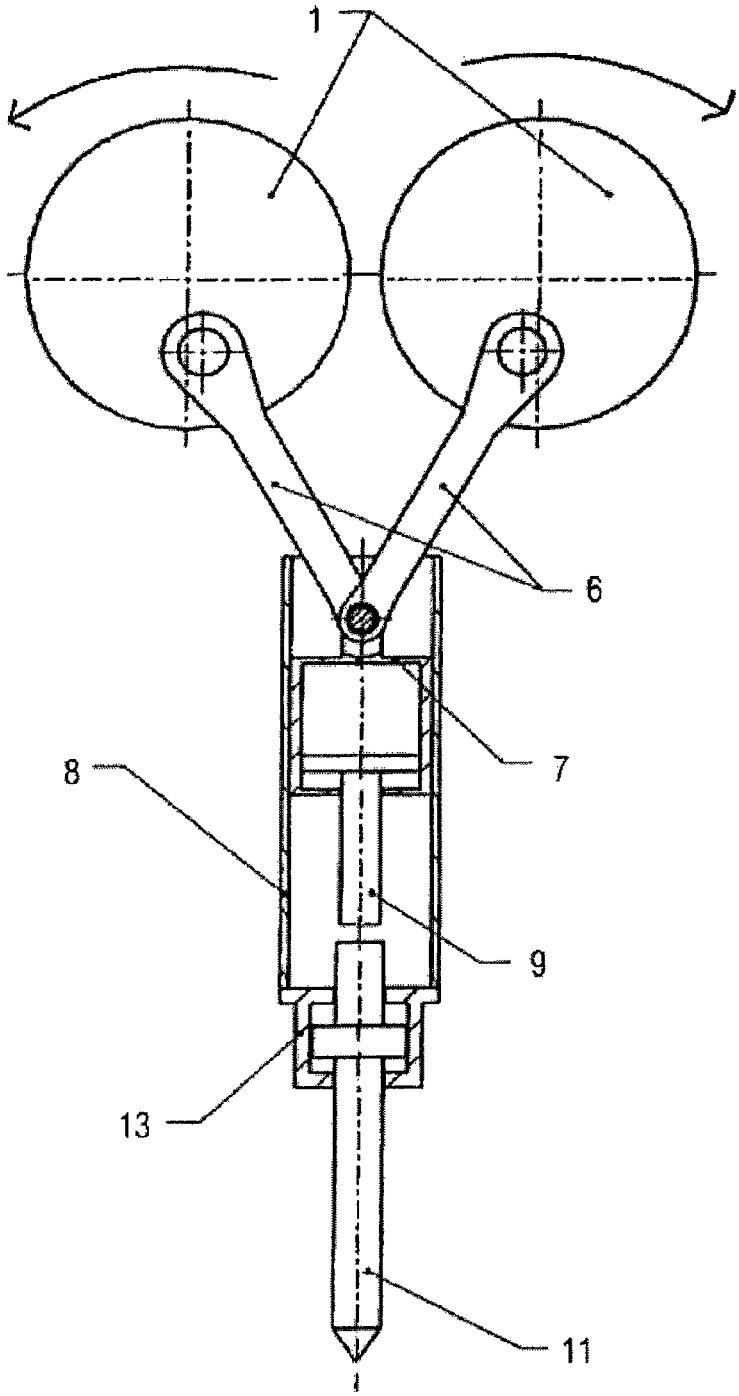
FIG. 8 illustrates another embodiment of the percussion mechanism.

FIG. 8 illustrates an embodiment of the percussion mechanism different from that in FIG. 1

In this case, two motors 1 are employed, each driving a connecting rod, thus causing drive piston 7 to move back and forth accordingly. The motors 1 are operated in counter rotating fashion as shown by the arrows.

The alternating torques of the motors cancel each other, thus preventing any lateral forces or pullout torque from acting on drive piston 7. The result is a smoother run and more comfortable operation when employing the percussion mechanism, for instance, in a hand-held power tool.

The percussion mechanism is suitable for use especially in a rock-drill and/or jackhammer or pavement breaker.

The invention claimed is:

1. A percussion mechanism, comprising:

a drive with a motor and a rotor provided in the motor;

a drive element that is driven back and forth in a guide unit by the drive;

a percussion element; and a coupling device that acts between the drive element and the percussion element and that permits the transfer of the movement of the drive element to the percussion element;

said motor being controllable so as to generate variable rotor speeds within one percussion cycle;

the motor being controllable so as to achieve, within one percussion cycle, a change of rotor rotational speed corresponding to an algorithm that is pre-selected for the rotor, and wherein said algorithm selects a movement of the rotor as a function of an actual movement of the percussion element.

2. The percussion mechanism as recited in claim 1, wherein the algorithm determines a fixed travel/time pattern, preset by at least one of a control feature and a regulating feature, for the movement of the rotor.

3. The percussion mechanism as recited in claim 1, said motor being controllable in a such a manner that the drive element, moves along a path that approximates a movement pattern of percussion element.

4. The percussion mechanism as recited in claim 1, said motor being controllable in such a manner that at least one:

a lower dead center position of the drive element, positioned toward percussion element, is traversed within each percussion cycle; and an upper dead center position of the drive element, positioned away from the percussion element, is not traversed within each percussion cycle.

5. The percussion mechanism as recited in claim 1, further comprising a conversion system that is located between the motor and the drive element and that converts a rotational movement generated by the motor into a linear movement of the drive element.

6. The percussion mechanism as recited in claim 5, said conversion system encompassing a gear mechanism that operates in such a manner that, during one percussion cycle, the motor generates several rotations of the rotor.

7. The percussion mechanism as recited in claim 1, in which the drive is provided with two mutually counter-rotating motors that jointly actuate the drive element.

8. The percussion mechanism as recited in claim 7, further comprising two conversion devices, each of which is associated with one of the motors, for converting the rotational movement generated by the motors into a linear movement of the drive element.

9. The percussion mechanism as recited in claim 1, wherein the percussion mechanism is a pneumatic-spring percussion mechanism;

the drive element comprises a drive piston;

the percussion element comprises a percussion piston; and the coupling device includes a pneumatic drive spring that is formed in a hollow space between the drive piston and the percussion piston and that transfers the movement of the drive piston to the percussion piston.

10. The percussion mechanism as recited in claim 9, wherein the coupling device is provided, in addition to the pneumatic drive spring, with a pneumatic recuperating spring operating between the drive piston and the percussion piston to support a return movement of the percussion piston after a stroke.

11. The percussion mechanism as recited in claim 1, in which the motor is one of an asynchronous motor, a reluctance motor, and a different synchronous motor.

12. The percussion mechanism as recited in claim 1, in which the motor is a self-contained, wire-wrapped closed-loop linear motor.

13. A percussion mechanism, comprising:

a drive with a motor and a rotor provided in the motor;

a drive element that is driven to move back and forth in a guide unit by the drive;

a percussion element; and a coupling device that acts between the drive element and the percussion element and that transfers the movement of the drive element to the percussion element;

said motor being controllable to generate variable rotor speeds in at least one of 1) within one percussion cycle and 2) from percussion cycle to percussion cycle;

said motor being controllable so as to allow, within a percussion cycle, the motor to rotate in a first direction, then stop, and then rotate in the opposite direction.

14. The percussion mechanism as recited in claim 13, said motor being controllable so as to allow variable rotor speeds generated in said at least one of 1) one percussion cycle and 2) from percussion cycle to percussion cycle in accordance with an algorithm that is preset for the movement of the rotor.

15. The percussion mechanism as recited in claim 14, said algorithm further comprising selecting a movement of the rotor as a function of an actual movement of the percussion element.

* * * * *